US008763344B2

(12) United States Patent
Irmscher et al.

(10) Patent No.: US 8,763,344 B2
(45) Date of Patent: Jul. 1, 2014

(54) METHOD FOR ERECTING AN UNDERGROUND CONSTRUCTION

(75) Inventors: Ilja Irmscher, Berlin (DE); Marc Peters, Freiburg (DE)

(73) Assignee: Herreknecht AG, Schwanou (DE)

( * ) Notice: Subject to any disclaimer, the term of this patent is extended or adjusted under 35 U.S.C. 154(b) by 258 days.

(21) Appl. No.: 13/319,238

(22) PCT Filed: Apr. 7, 2010

(86) PCT No.: PCT/EP2010/002183

§ 371 (c)(1),
(2), (4) Date: Mar. 19, 2012

(87) PCT Pub. No.: WO2010/127751

PCT Pub. Date: Nov. 11, 2010

(65) Prior Publication Data

US 2012/0163919 A1 Jun. 28, 2012

(30) Foreign Application Priority Data

May 8, 2009 (DE) ..... 10 2009 020 517

(51) Int. Cl.

| | |
|---|---|
| ***E04G 21/00*** | (2006.01) |
| ***E04G 23/00*** | (2006.01) |
| ***E02D 7/28*** | (2006.01) |
| ***E02D 23/08*** | (2006.01) |
| ***E04H 6/12*** | (2006.01) |
| ***E02D 29/045*** | (2006.01) |
| ***E21D 13/00*** | (2006.01) |
| ***E21D 7/00*** | (2006.01) |
| ***E21D 1/08*** | (2006.01) |

(52) U.S. Cl.

CPC *E21D 13/00* (2013.01); *E02D 7/28* (2013.01); *E02D 23/08* (2013.01); *E04H 6/12* (2013.01); *E02D 29/045* (2013.01); *E21D 7/00* (2013.01); *E21D 1/08* (2013.01)

USPC ..... 52/741.11; 52/745.01; 52/169.1

(58) Field of Classification Search

USPC ..... 52/741.11–741.15, 169.1, 169.6, 175, 52/745.01, 745.19; 405/133

See application file for complete search history.

(56) References Cited

U.S. PATENT DOCUMENTS 4,005,582 A * 2/1977 Tamaro ..... 405/267
4,701,073 A * 10/1987 Sainsbury ..... 405/133

(Continued)

FOREIGN PATENT DOCUMENTS

EP 118723 A2 * 9/1984 ..... E04H 6/10

*Primary Examiner* — Brian Glessner
*Assistant Examiner* — Brian D Mattei
(74) *Attorney, Agent, or Firm* — Mark Rodgers

(57) ABSTRACT

The invention relates to a method for erecting an underground structure, wherein the method is intended to ensure that the underground structure is assembled as safely as possible. The method is characterized in that a shaft is sunk at the erection site and the shaft is closed off by a cover in which an opening is provided, in that a lifting/lowering device is provided in the region of the opening, in that a locking mechanism is provided in the shaft below the opening, in that a section of the structure is provided in the region of the opening and is connected to the lifting/lowering device, is lowered through the opening down to the locking mechanism and locked and is then released from the lifting/lowering device after locking, in that a process cycle is performed in which a further section of the structure is provided in the region of the opening, said section is connected to the lifting/lowering device and to the locked section of the structure, then the locking of the previous section is released, the structure sections situated in the shaft are lowered until the uppermost section is situated in the locking region, and the uppermost section of the structure is locked, and this process cycle is repeated until the sections required for erecting the underground structure have been inserted into the shaft.

16 Claims, 7 Drawing Sheets

(56) References Cited

Figure 3:
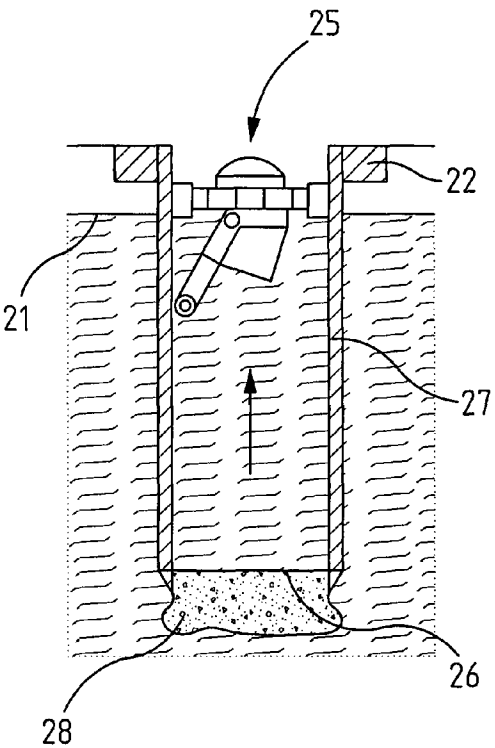

U.S. PATENT DOCUMENTS 4,938,634 A * 7/1990 Lee ..... 405/229
5,595,459 A * 1/1997 LoMonaco ..... 405/272
5,654,015 A * 8/1997 Franklin ..... 425/65
8,127,418 B2 * 3/2012 Bertelsen et al. ..... 29/281.4
2002/0066255 A1 * 6/2002 Harris et al. ..... 52/742.14
2008/0066285 A1 * 3/2008 Bertelsem et al. ..... 29/429
2010/0325973 A1 * 12/2010 Hirshberg ..... 52/169.5

* cited by examiner

METHOD FOR ERECTING AN UNDERGROUND CONSTRUCTION

The invention relates to a method for erecting an underground structure.

In conurbations the space for erecting buildings above ground in central locations is becoming increasingly more limited. Thus, a particular problem in this respect is the erection of functional buildings, such as parking garages or warehouses, since the ground on which they are erected as rising structures is becoming increasingly more expensive owing to the lack of available space, which means that erecting them becomes uneconomic or their operation is associated with such high operating costs that economic operation is not possible. Furthermore, owing to their auxiliary function, these types of structures are less desirable in the urban mix from a town planning point of view, but functionally indispensible.

Considerations are therefore given to erecting structures or buildings underground instead of above ground. In this case, construction pits are frequently produced which have to be safeguarded in a complicated manner and secured against the ingress of water. The corresponding structures are then erected in these construction pits, and the construction pit is then closed off again. Such methods are associated with very high costs and with a very large technical outlay which is directly manifested in the erection costs and especially in the erection time.

The object of the invention is therefore to provide a method by means of which underground structures can be erected. The nature of the requirement for this method is that the erection can take place swiftly, cost-effectively, with a high degree of quality and also safely in terms of worker protection.

The object according to the invention is achieved in that a shaft is sunk at a construction site, and the shaft is closed off by a cover in which an opening is provided, in that a lifting/lowering device is provided in the region of the opening, in that a locking mechanism is provided in the shaft in the region of the opening, preferably below the opening, in that a section of the structure is provided in the region of the opening and is connected to the lifting/lowering device, is lowered through the opening down to the locking mechanism and is locked and then is released from the lifting/lowering device after locking, in that a process cycle is performed in which a further section of the structure is provided in the region of the opening, preferably above the opening, said section is connected to the lifting/lowering device and to the locked section of the structure, then the locking of the previous section is released, the structure sections situated in the shaft are lowered until the uppermost section is situated in the locking region, and the uppermost section of the structure is locked, and this process cycle is repeated until the sections required for erecting the underground structure have been inserted into the shaft. Here, the shaft is understood to be the outer structure and the remaining elements to be the inner structure.

Advantageous here is the fact that the shaft functions as a construction pit which can be produced simply and safely, at the same time the fact that the erection of the structure in the shaft, which through its shaft wall and the lining of the shaft wall is a constituent part of the structure, can be produced directly and simply, and the installation of the structure section, each in their own right. Assembly takes place in such a way (namely from top to bottom) that there is no need to work directly inside the shaft during the assembly of the sections, but the work can be carried out up top on the cover of the shaft outside of the shaft so as to provide a high degree of worker safety and work quality during the erection, and at the same time no transport of material into the shaft itself, and no erection activities in the shaft, are necessary during the erection of the structure sections, thereby reducing costs and increasing worker safety, and at the same time, owing to the fact that modules can be delivered directly as prefabricated modules, these can be assembled directly, with the result that, by virtue of the at least partial preassembly possibility depending on the available transport infrastructure, the installation of the structure sections can take place quickly and cost-effectively.

A further teaching of the invention provides that the structure is a building, preferably an underground parking garage or (underground) storage facility, particularly preferably an underground, particularly preferably automated, parking system or (underground) storage facility. Specifically in the case of such above-described building types, an erection above ground in the inner city area is not possible mostly for reasons associated with town planning and because of a lack of availability of suitable plots of land. The invention advantageously provides that the functional areas necessary for operating the underground building are integrated into a building which is to be subsequently erected above said underground building or into an existing building. It is thereby possible to assign a secondary use to the plot of land, namely to integrate shaft structures in above-ground buildings and/or to use them as a foundation measure.

A further teaching of the invention provides that the shaft is sunk in the manner of a mine by means of boring and blasting, with a shaft boring machine using full-face cutting and/or part-face cutting and/or by means of shield driving. Further mining processes can also be used, such as freezing shaft operation or the like, in the case of particularly difficult geological terrain. It is particularly advantageous to use automated shaft boring machines using part-face or full-face cutting, by means of which it is also possible to sink the shaft below the groundwater line and thus directly in the groundwater without groundwater retention.

A further teaching of the invention provides that the opening in the cover can be closed off, thus making it possible to carry out all the preassembly activities for the individual sections on the cover, to place the respective section to be assembled on the underlying locked section and to connect it thereto, to connect the respective (uppermost) section to be assembled to the lifting/lowering device, to release the locking mechanism, to open the opening again, to lift the section, to lower the entire construction to the level of the just-assembled section, to lock it and to continue the method, or alternatively to then connect these sections to the lifting/lowering device, to lift them, to open the opening again, to place the section on the underlying locked section and to connect it and to continue the method.

A further teaching of the invention provides that lifting and lowering take place with a lifting/lowering device having at least one drive and, as connecting or advancing means, at least one hydraulic cylinder, one cable, one threaded rod and/or one toothed rack. It is possible in a simple manner through these connecting or advancing means to safely carry out lifting and lowering in guided movements. It is advantageous here that a bridge, which functions as a superordinate carrier frame of the lifting/lowering device, is provided above the opening. It is further advantageous that an auxiliary frame, which is particularly preferably connected to the connecting or advancing means, is provided between the structure section and the lifting/lowering device. Using the auxiliary frame it is possible in a simple manner to produce a connection between the work section and the lifting/lowering device, with the auxiliary frame simultaneously opening up the possibility of controlled guidance, alignment and/or leveling.

A further teaching of the invention provides that the locking mechanism is provided directly below the cover, on the cover or on a foundation of the shaft structure. It is thus possible to lock the structure section situated in the shaft and at the same time to close off the opening situated above, with the result that the assembly activities for the next structure section can be carried out in a protected area, which means, for example, that the personnel working there are secured against falling into the shaft. It is also possible that part of the structure projects from the shaft and the cover of the shaft is situated below. Here, the next section of the structure is then assembled directly above ground, and this is followed by the connection to the lifting/lowering device for lowering the structure for the assembly of the next section. It is advantageous that locking with the locking mechanism is performed via flexurally rigid straps, flat latches, wedges, pins and/or retaining jaws which are particularly preferably designed to be movable. This ensures that a sufficiently large retaining force can be achieved, and at the same time the locking mechanism is of simple design. This facilitates handling and maintenance work.

A further teaching of the invention provides that the shaft bottom is secured against mechanical stress from rock, water ingress and the like. At the same time it is advantageous that, either on the shaft bottom or in a region of the shaft, a foundation is provided for receiving the lower structure section and hence also for fastening the lower structure section in this shaft region. It is further advantageously possible that there be provided in the shaft a guide which guides the structure sections during lowering/lifting. This ensures in a simple manner that the structure sections can on the one hand be transported safely and with the desired movements in the shaft and can also on the other hand be brought into the respective end position in a guided manner. In this case, the guide can take the form of a guide system. Alternatively, systems such as, for example, rollers can be provided which perform direct guidance with respect to the shaft wall and are designed to be adjustable, if appropriate electromechanically or electrohydraulically. Alternatively, laser-controlled, guideless, hydraulic lowering can be envisioned. It is possible in this case to dispense with the preassembly of the guide or the carrying along of the guide. Lowering/lifting is performed at a low speed and in an extremely low-impact manner in order to ensure a precise arrangement within the shaft and to avoid inadmissible deformations.

A further teaching of the invention provides that the first structure section (the lowermost structure section) is provided with at least one connecting section for locking the structure on the foundation. As a result, a secure connection between the structure sections in the foundation is possible. At the same time it is advantageous that at least one section of the structure is connected to the shaft wall after the sections of the structure have been installed. This ensures stable positioning of the structure sections in the shaft.

A further teaching of the invention provides that a ventilation and venting system and/or supply system and/or further systems, a drainage system for parking pallets or car parking places, a fire extinguishing system, a work lift, a pallet cleaning system, a lighting system and/or electronic sensors is/are provided, wherein the system/the systems are preferably installed section by section, particularly preferably with the assembly of a structure section. On the one hand, it is thereby possible to provide all the elements necessary for the subsequent operation of the structure during the actual assembly of an individual section, which means that subsequent assembly activities inside the structure, and hence in the shaft region, can be dispensed with. This increases the assembly safety for the personnel involved in the assembly and increases the quality of the assembly. At the same time it is also possible to provide and to assemble at this point the subsequent operating elements, such as, for example, parking decks, in particular guide rails for parking pallets, storage surfaces for cars or other goods to be stored or the like, and the cabling and piping of the technical systems, with the result that substantially the entire assembly of the system is completed with the end of the lowering of the structure sections.

A further teaching of the invention provides that the cover of the shaft is removed after the completion of the assembly of the structure sections, and that a shaft closure is preferably fitted. It is further advantageous that an above-ground structure part is then erected for the structure, said structure part allowing subsequent operation and subsequent maintenance of the structure.

Figure 7:
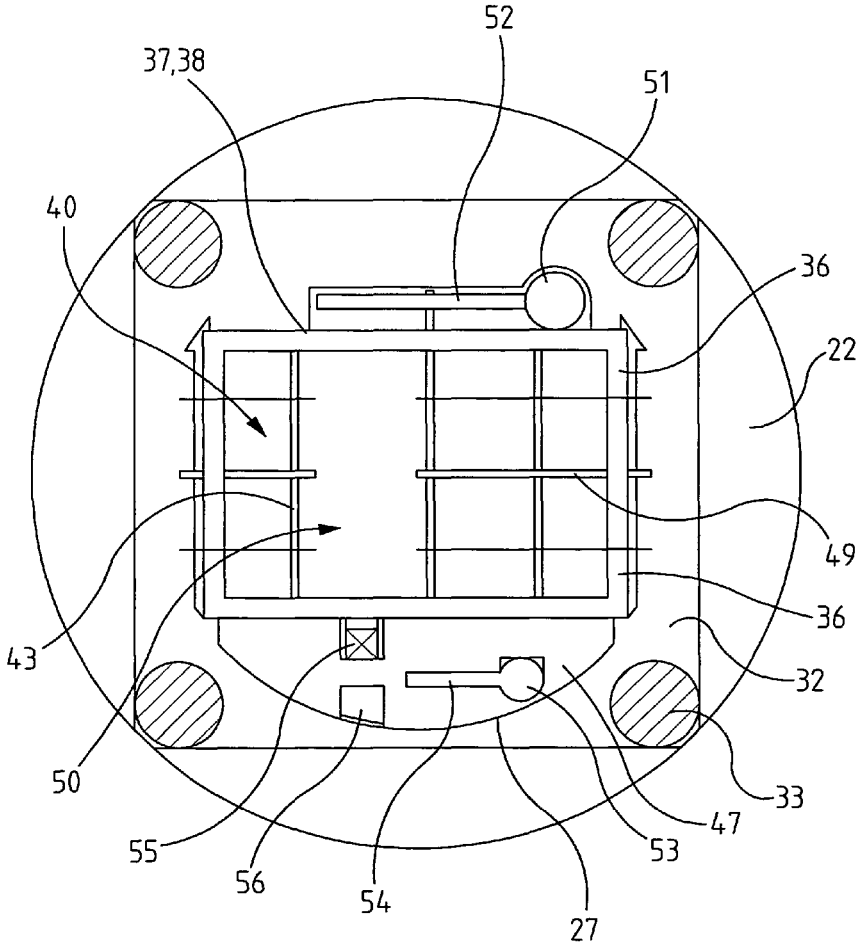
Figure 8:
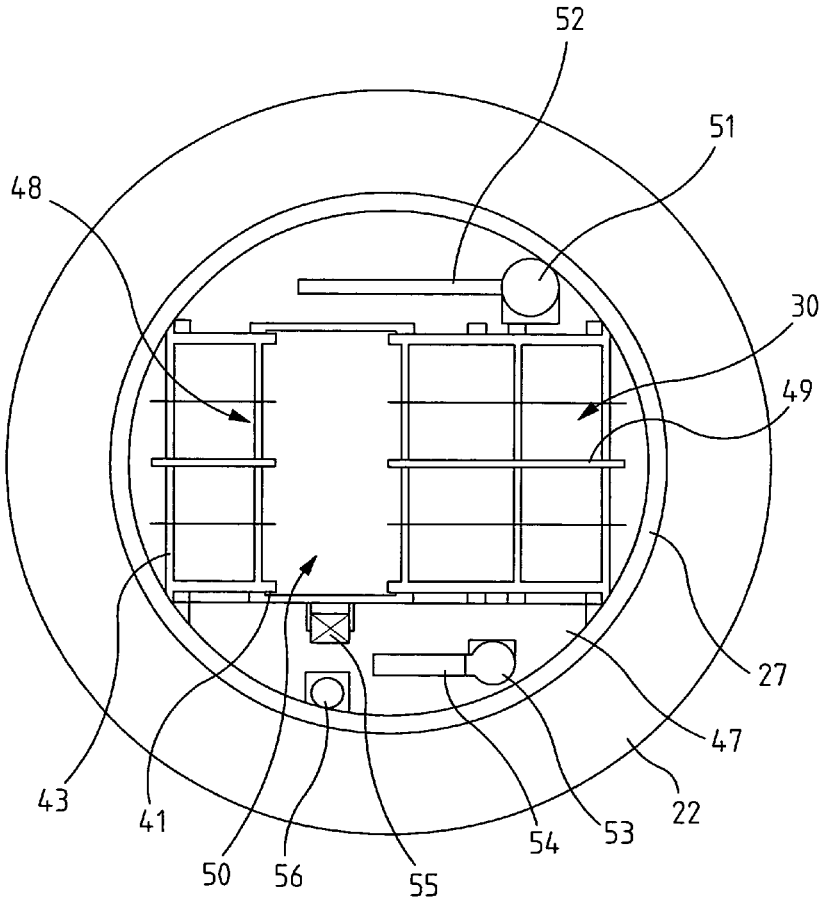
Figure 9:
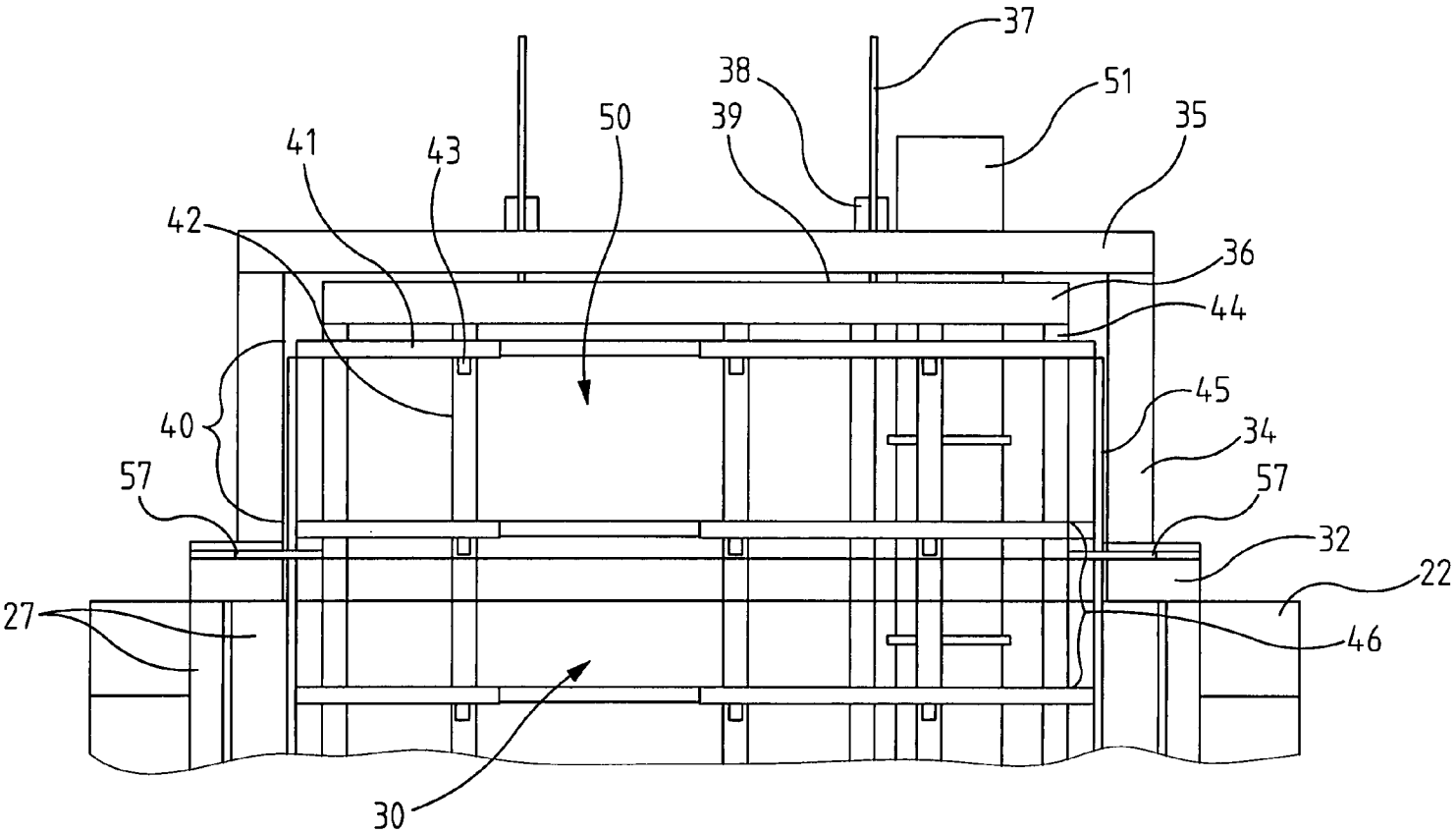
Figure 10:
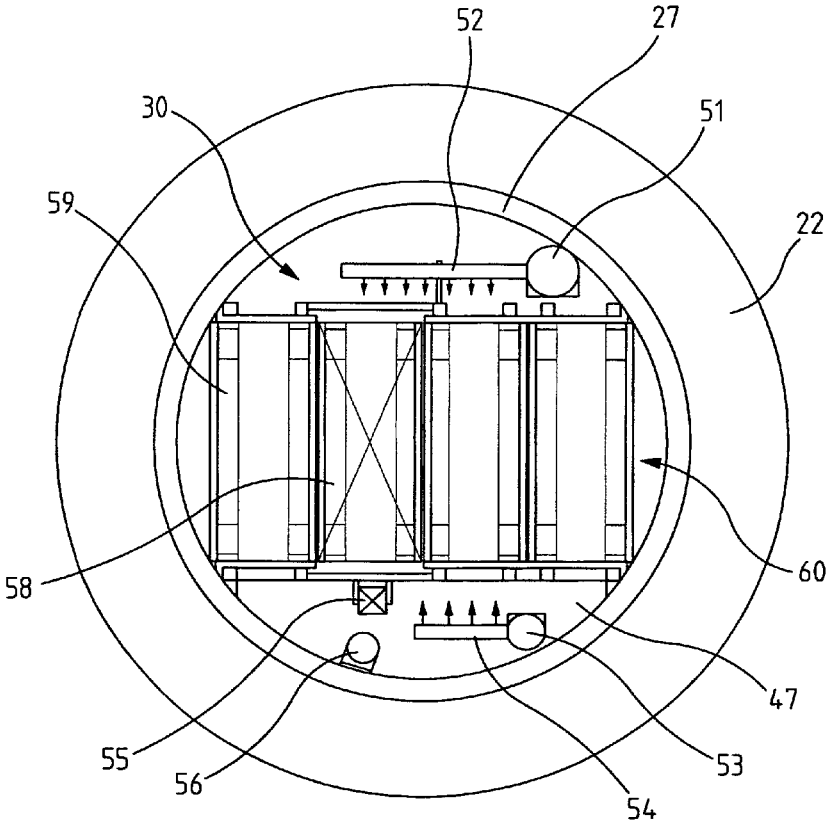
Figure 12:
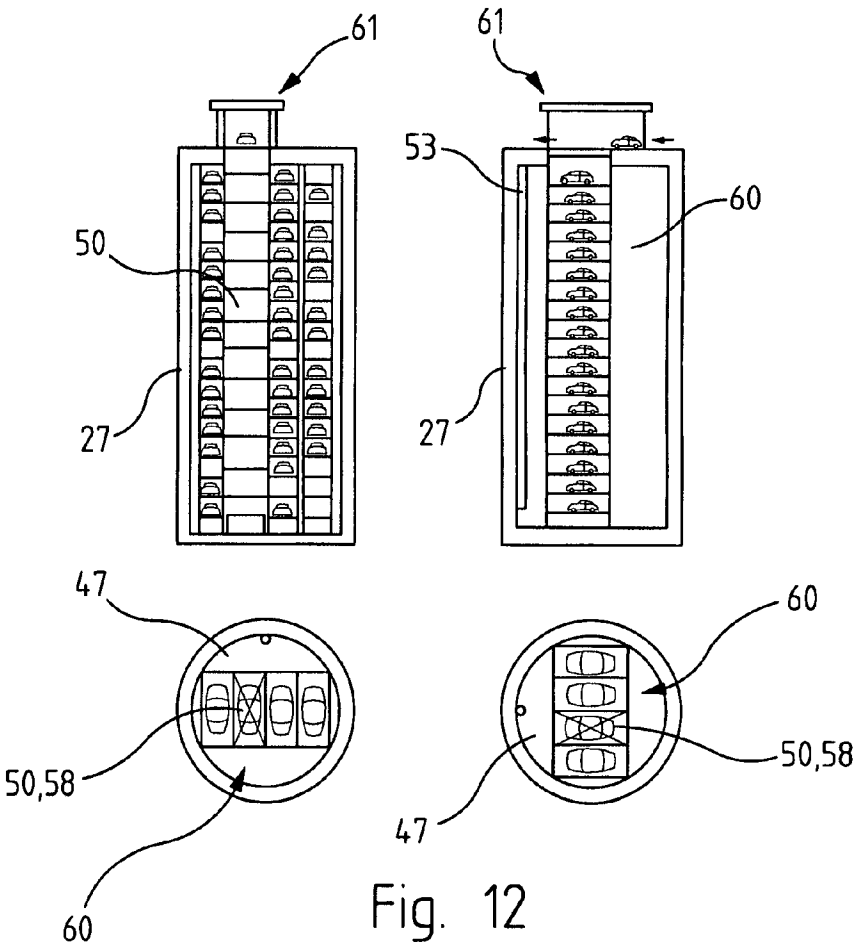
Figure 11:
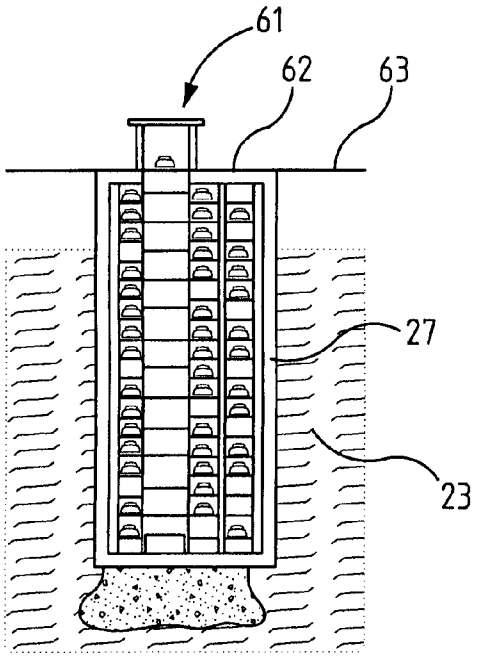

A particularly preferred exemplary embodiment of the method according to the invention is explained in more detail below with reference to the drawing, in which:

FIGS. 1-6: show a lateral sectional view of the individual production moments during the production of the shaft, FIG. 7: shows a plan view of the above-ground assembly area, FIG. 8: shows a sectional view through a structure section inserted underground, FIG. 9: shows a sectional view of the above-ground assembly area, FIG. 10: shows a view of FIG. 8 with an assembled parking system, and FIGS. 11 and 12: show sectional views through the completely assembled automatic parking system.

Figure 2:
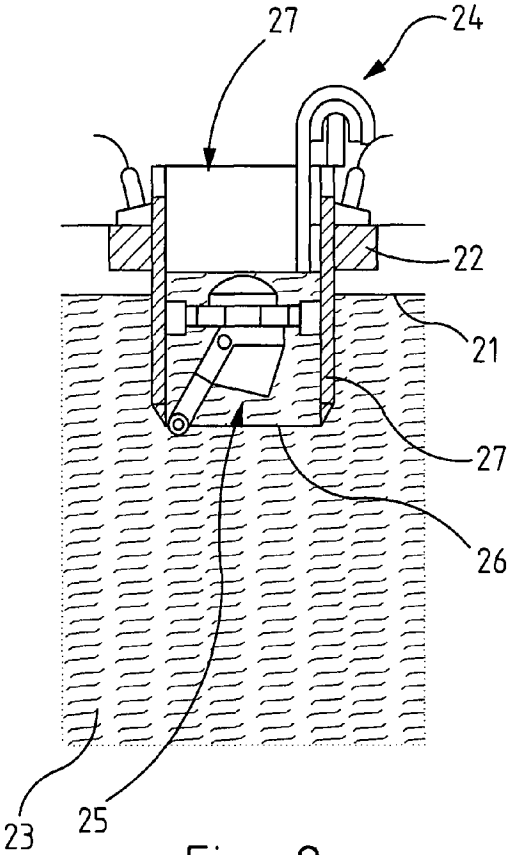
Figure 1:
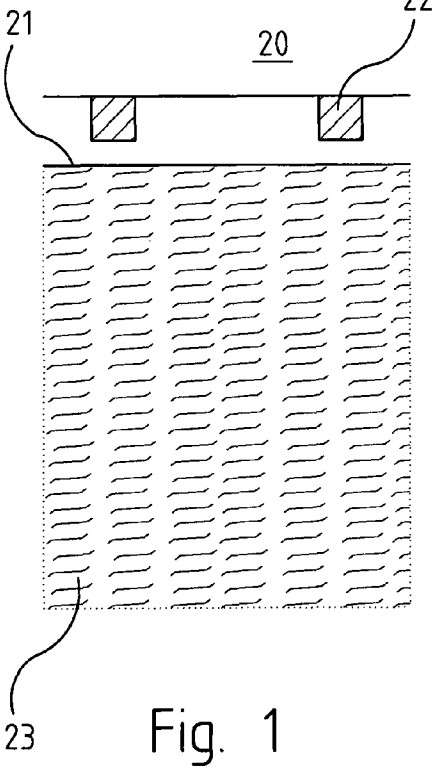
Figures 4, 5, 6:
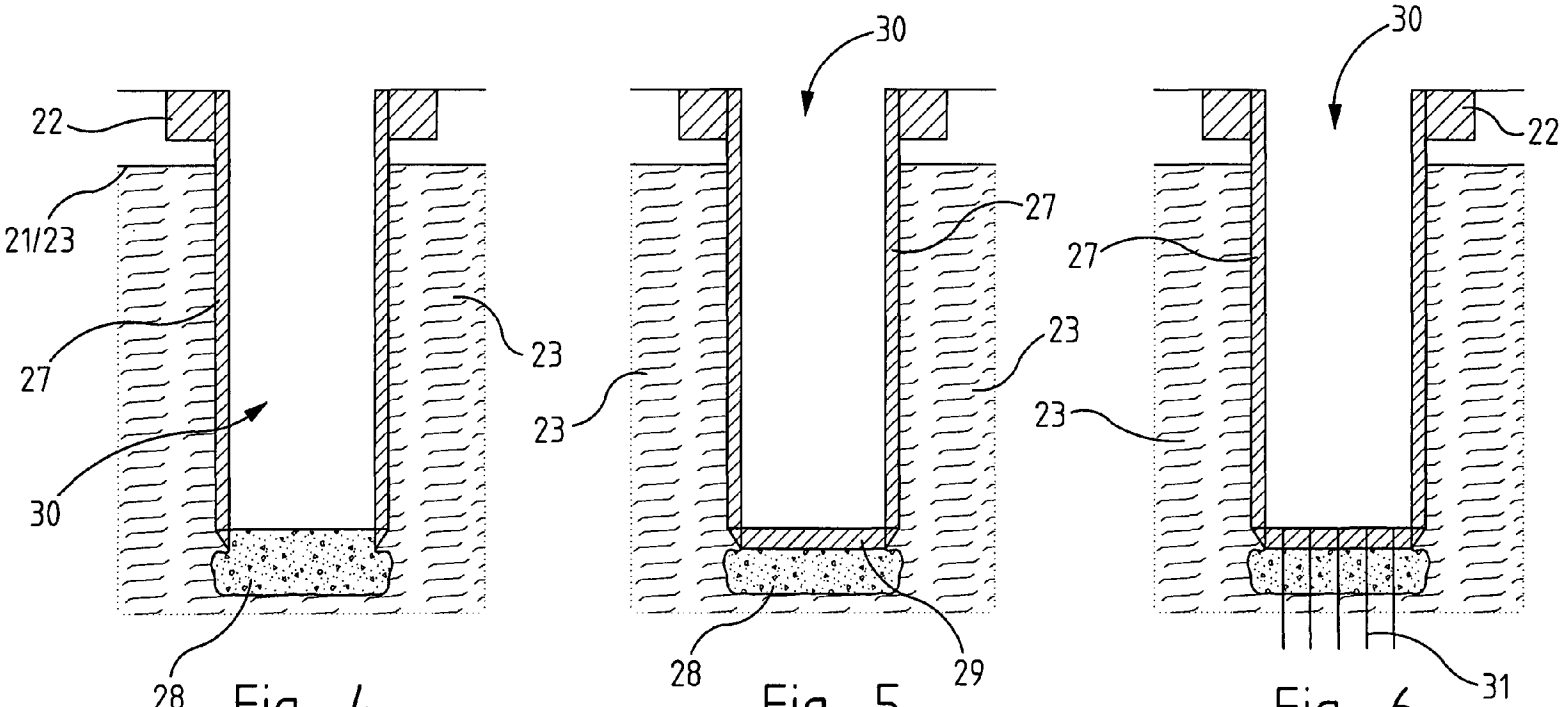

On a construction site 20 for erecting a structure, a foundation 22 is produced. A shaft boring machine, here in the form of a vertical shaft boring machine which uses a part-face cutting process and consists of an above-ground part 24 and an underground part 25, is then erected and work is begun to sink the shaft 30. While the shaft 30 is being sunk, the shaft is lined with a lining 27. As soon as the shaft 30 penetrates the groundwater line 21 during sinking, the shaft 30 is filled with groundwater 23. The underground part of the shaft boring machine 25 is designed for such an operation (FIG. 2). After sinking the shaft, for example down to a depth of 60-100 m (smaller or greater depths and large diameters are possible for structures, in particular storage facilities with a relatively low exchange frequency for the stored objects), and completely lining the shaft 30, the underground part of the shaft boring machine 25 is removed and the shaft bottom 26 is closed off by a concrete plug 28 (FIG. 3). Next, the water 23 situated in the shaft 30 is pumped off (FIG. 4) and the shaft bottom 26 is closed off by a lining 29 (FIG. 5). Then, for example, an anchoring 31 is inserted through the resulting shaft bottom lining 29 into the concrete plug 28 and into the rock.

A cover 32 is then applied above ground to the shaft 30. Situated on the cover 32 are supports 33 which are a constituent part of a bridge 34, the bridge 34 having bridge load beams 35 extending around as a frame and resting on the supports 33, which can be adjusted for leveling purposes. The bridge load beams 35 are provided with openings which act as a guide 38. Arranged through these guides 38 are tie rods 37 which are connected to an auxiliary frame 36 via connections 39. The auxiliary frame 36 can be moved up and down via the tie rods 37. Instead of the tie rods, or in addition to them, double-acting hydraulic cylinders (not shown) are used. Alternatively, cables, threaded rods or toothed racks can also be used. The tie rods 37 are connected to a drive means (not shown) via which the movement is introduced. Situated on the underside of the auxiliary frame 36 are fastening elements 44 onto which a structure section 40 is connected to the auxiliary frame. In the present exemplary embodiment, a structure section 40 is designed as a steel construction comprising beams 41, 43 and supports 42. Provided here for the first structure section are a structure element, for example a plate, together with a connecting means (not shown), which are connected to the foundation of the structure, the shaft bottom 26 or the shaft walls or its lining 27, and on which the structure then stands. Supports 42 are set up and mounted on this structure element. These supports 42 are connected to beams 41, 43, these beams then forming the end of the structure section 40. The auxiliary frame 36 is connected to the uppermost beam plane via the fastenings 44. By lowering the tie rods 37, the structure section 40 is lowered and secured in its lowered position by means of locking mechanisms 57 such that it cannot fall into the shaft 30. The fastenings 44 of the auxiliary frame 36 are then released and the auxiliary frame 36 is moved upward again via the tie rods 37. The auxiliary frame 36 is connected to the tie rods 37 via fastenings 39. The opening in the shaft cover 32 is then closed off (not shown).

The next structure section 40 is either delivered in a modular manner and arranged in the shaft region or the structure section 40 is produced in situ from individual supports 42 and beams 41, 43. Next, the structure section 40 is connected to the auxiliary frame 36 via the fastenings 44. The shaft opening is then opened again and the new structure section 40 is lowered onto the underlying, previously assembled structure section 46 and connected thereto.

Alternatively, the upper end of the lowered shaft section is situated above the closed shaft opening in such a way that the upper end projects beyond the cover. The next structure section 40 is then connected directly to the upper end or it is directly erected in situ on the upper end from individual supports 42 and beams 41, 43. The auxiliary frame 36 is then connected to the structure section 40 via the fastenings 44.

Then, in both cases, the locking mechanisms 57 are released and the building section 40 is lowered again together with the underlying building sections 46 and, as soon as the uppermost plane has arrived in the locking region, is locked by means of the locking mechanism 57.

Mounted on each of the structure sections 40 and 46 are also further subassemblies and components belonging to the fields of conveying engineering, electrical installation and services engineering. A constituent part of a structure section 40 is an air inlet line 51 and an air outlet line 53. Departing from the air inlet line 51 toward the air outlet line 53, in each case after a certain number of structure sections, for example two or three, there are provided an air inlet distributor 52 and an air intake point 54. The air inlet distributor 52 and air intake point 54 can also be arranged in an alternating manner with respect to one another. Furthermore, a structure section 40 is provided with a section of a work lift 55 and of a ladder 56. In addition, a climbing ladder 56 is provided as an emergency guide on the shaft lining 27. Also present in a structure section 40 is an elevator opening 50, through which the elevator of the parking system is subsequently arranged. Transportable parking places 59, which can be transported on rails (not shown) for example, are provided on the individual structure sections. The elevator itself has an elevator surface 58 which is then moved out from the elevator over the rails. The parking places 59 form a parking system level 60 arranged on a structure section.

A structure section 40 has an intermediate level 47 at certain intervals from one another. This intermediate level can alternatively either be fastened subsequently between the structure and shaft wall, or the intermediate level 47 is provided directly as a constituent part of a structure section 40 and lowered together with the remaining structure sections in the shaft.

To ensure that a precise arrangement of the structure sections 40, 46 in the shaft 30 can take place, a guide system consisting of individual guides which allow precise guidance can be provided. The guide system itself may be a constituent part of the structure, which means that the structure is additionally fastened in the shaft 30. Following complete erection of the structure in the shaft 30, individual or all structure sections can additionally be connected to the shaft lining 27 in order to additionally increase the stability (not shown).

FIG. 11 and FIG. 12 depict an automatic parking system arranged in a shaft 30. After the individual structure sections 40, 46 and the intermediate levels 47 have been arranged in the shaft 30, the cover 32 is removed and a shaft closure 62 is fitted. The shaft closure 62 is located substantially at the level of the land surface 63. The shaft closure 62 is likewise provided with an opening, which corresponds to the shaft of the vertical conveyor 50 of the automatic parking system. An above-ground building 61 in the form of a transfer cabin of the automatic parking system is erected above this opening.

LIST OF REFERENCE SIGNS

20 Construction site
21 Groundwater line
22 Foundation
23 Groundwater
24 Above-ground shaft boring machine
25 Underground shaft boring machine
26 Bottom
27 Shaft lining
28 Concrete plug
29 Lined shaft bottom
30 Shaft
31 Anchoring
32 Cover
33 Support
34 Bridge
35 Bridge load beam
36 Auxiliary frame
37 Tie rod
38 Guide
39 Fastening
40 Structure section
41 Beam
42 Support
43 Beam
44 Fastening of the auxiliary frame
45 Wastewater pipes
46 Underlying structure section
47 Intermediate level
48 Installed structure section
49 Beam
50 Shaft of the vertical conveyor
51 Air inlet line
52 Air inlet distribution
53 Air outlet line
54 Air intake point
55 Access elevator
56 Climbing ladder
57 Locking mechanism
58 Elevator surface
59 Parking place
60 Parking system level

61 Above-ground building
62 Shaft closure
63 Land surface

The invention claimed is:

1. A method for erecting an underground structure, characterized in that a shaft is sunk at the erection site and the shaft is closed off by a cover in which an opening is provided, in that a lifting/lowering device is provided in the region of the opening, in that a locking mechanism is provided in the shaft in the region of the opening, in that a section of the structure is provided in the region of the opening and is connected to the lifting/lowering device, is lowered through the opening down to the locking mechanism and locked and is then released from the lifting/lowering device after locking, in that a process cycle is performed in which a further section of the structure is provided in the region of the opening, said section is connected to the lifting/lowering device and to the locked section of the structure, then the locking of the previous section is released, the structure sections situated in the shaft are lowered until the uppermost section is situated in the locking region, and the uppermost section of the structure is locked, and this process cycle is repeated until the sections required for erecting the underground structure have been inserted into the shaft, characterized in that the lifting/lowering device comprises a stationary bridge above the opening.

2. A method for erecting an underground structure, characterized in that a shaft is sunk at the erection site and the shaft is closed off by a cover in which an opening is provided, in that a lifting/lowering device is provided in the region of the opening, in that a locking mechanism is provided in the shaft in the region of the opening, in that a section of the structure is provided in the region of the opening and is connected to the lifting/lowering device, is lowered through the opening down to the locking mechanism and locked and is then released from the lifting/lowering device after locking, in that a process cycle is performed in which a further section of the structure is provided in the region of the opening, said section is connected to the lifting/lowering device and to the locked section of the structure, then the locking of the previous section is released, the structure sections situated in the shaft are lowered until the uppermost section is situated in the locking region, and the uppermost section of the structure is locked, and this process cycle is repeated until the sections required for erecting the underground structure have been inserted into the shaft, characterized in that a foundation for the structure is provided in the shaft, characterized in that the first structure section is provided with at least one connecting section for locking the structure on the foundation.

3. The method as claimed in claim 2, characterized in that the structure is a building, including at least one of an underground parking garage, an automated parking garage, a storage facility or an automated storage facility.

4. The method as claimed in claim 2, characterized in that the shaft is sunk in the manner of a mine by means of boring and blasting, with a shaft boring machine using full-face cutting and/or part-face cutting and/or by means of shield driving.

5. The method as claimed in claim 2, characterized in that the opening in the cover can be closed off.

6. The method as claimed in claim 2, characterized in that lifting and lowering take place with a lifting/lowering device having at least at least one cable, one threaded rod and/or one toothed rack.

7. The method as claimed in claim 2, characterized in that an auxiliary frame is provided between a building section and the lifting/lowering device.

8. The method as claimed in claim 2, characterized in that locking takes place by means of wedges, pins and/or retaining jaws which are designed to be movable.

9. The method as claimed in claim 2, characterized in that the locking mechanism is provided directly below the cover, on the cover or on a foundation of the shaft structure.

10. The method as claimed in claim 2, characterized in that a guide which guides the structure sections during lowering/lifting is provided in the shaft.

11. The method as claimed in claim 10, characterized in that the guide is a constituent part of the structure.

12. The method as claimed in claim 2, characterized in that at least one section of the structure is connected to the shaft wall after the sections of the structure have been installed.

13. The method as claimed in claim 2, characterized in that a ventilation and venting system and/or supply system are provided, wherein the system/the systems are installed section by section.

14. The method as claimed in claim 2, characterized in that the cover is removed after the completion of the assembly of the sections.

15. The method as claimed in claim 2, characterized in that a shaft closure is fitted.

16. The method as claimed in claim 2, characterized in that an above-ground structure part is erected for the structure.

* * * * *